United States Patent [19]

Skaletz

[11] 4,115,216

[45] Sep. 19, 1978

[54] PROCESS FOR THE ELECTROCHEMICAL DIHYDROGENATION OF NAPHTHYL ETHERS

[75] Inventor: Detlev Herbert Skaletz, Mainz, Fed. Rep. of Germany

[73] Assignee: Hoechst Aktiengesellschaft, Frankfurt am Main, Fed. Rep. of Germany

[21] Appl. No.: 855,355

[22] Filed: Nov. 28, 1977

Related U.S. Application Data

[63] Continuation-in-part of Ser. No. 790,671, Apr. 25, 1977.

[30] Foreign Application Priority Data

Sep. 29, 1977 [DE] Fed. Rep. of Germany ..... 2743762

[51] Int. Cl.[2] ..... C25B 3/04; C25B 11/04; C25B 11/12

[52] U.S. Cl. ..... 204/73 R

[58] Field of Search ..... 204/59 R, 73 R

[56] References Cited

U.S. PATENT DOCUMENTS

| | | | |
|---|---|---|---|
| 3,440,154 | 4/1969 | Baizer | 204/73 R |
| 3,485,726 | 12/1969 | Misono et al. | 204/59 R |
| 3,492,207 | 1/1970 | Yang et al. | 204/73 R |
| 3,684,669 | 8/1972 | Matthews | 204/73 R |
| 3,700,572 | 10/1972 | Hatayama et al. | 204/73 R |
| 4,022,673 | 5/1977 | Connolly | 204/73 R |

OTHER PUBLICATIONS

Diamond et al., J. Amer. Chem. Soc., vol. 74, pp. 4126–4127, (1952).

*Primary Examiner*—F.C. Edmundson
*Attorney, Agent, or Firm*—Curtis, Morris & Safford

[57] ABSTRACT

Naphthyl ethers having at least one ether group may be dihydrogenated in an electrochemical manner by electrolysis of the naphthyl ethers in a solvent consisting essentially of an alkanol having from 1 to 3 carbon atoms, optionally in admixture with a small amount of a cosolvent and containing no more than about 5% by volume of water in the presence of at least one supporting electrolyte selected from the group consisting of tetramethylammonium salt
tetraethylammonium salt
tetramethylammonium hydroxide
tetraethylammonium hydroxide
tetramethylphosphonium salt
tetraethylphosphonium salt
tetramethylphosphonium hydroxide and
tetraethylphosphonium hydroxide in a continuous flow cell with separation of the cathode and anode zones, with the use of a solid cathode having a more cathodic hydrogen overvoltage than that of Cu and a usual solid anode, at temperatures of from −20° to +120° C, and at a pH of more than about 8, according to the galvanostatic operation mode.

The dihydrogenation of naphthyl-ethers having the ether group in 2-position is preferred since β-tetralones are obtained via the 1,4-, 3,4- and 1,2-dihydroproducts and hydrolysis thereof; tetralones being important starting substances for the synthesis of pharmacologically interesting compounds. The process can be carried out on an industrial scale with high current density and high space-time yields as well as relative low specific energy consumption.

9 Claims, No Drawings

PROCESS FOR THE ELECTROCHEMICAL DIHYDROGENATION OF NAPHTHYL ETHERS

This application is a continuation-in-part of Ser. No. 790,671, filed Apr. 25, 1977.

It is known that aromatic hydrocarbons are selectively reduced to form the corresponding dihydro compounds (see F. Beck, Elektroorganische Chemie, Weinheim/Bergstraβe, W.-Germany, 1974, pp. 148–151). Thus, naphthalene has been reduced to 1,4-dihydronaphthalene in a 1:1 mixture of hexamethylphosphoric acid triamide and methanol with a current efficiency of 85% and a product yield of 88%. The current efficiency is 80% and the product yield 98% when a Hg cathode and a quaternary ammonium salt such as tetraethylammonium tosylate as supporting electrolyte in 75% acetonitrile are used. Other cathode materials (graphite, Al, Pt etc.), supporting electrolyte (LiCl, $NH_4CL$ etc.) and solvents (ethylene diamine, $H_2O$, diglyme etc.) have been used for this purpose, too.

It is also known that especially alkoxylated naphthalene derivatives are reduced according to electrochemical methods to form the corresponding dihydro compounds (G. B. Diamond and M. D. Soffer, J. Am. Chem. Soc. 74, 1972, pp. 4126/27), which literature reference describes above all the electrochemical reduction of 2-naphthyl ethers to the $\Delta^2$-enol ethers, which for their part may be converted to the enols by hydrolysis, and the enols are then rearranged to form the corresponding β-tetralones. β-Tetralones are important starting substances for the synthesis of analgetics and morphine- and steroid-like substances etc. In the presence of Na-alkoxide, the chemical reduction of the 2-naphthyl ethers with sodium in alcohol is said to result in a rearrangement of the $\Delta^2$-enol ethers which are supposed to be formed first to the $\Delta^1$-enol ethers where the double bond is then in conjugation position to the aromatic ring system of the ring which is not affected by the reduction.

By hydrolysis and rearrangement, the $\Delta^1$-enol ethers are converted to the corresponding β-tetralones too; however, they are further reduced to the tetrahydro compounds by excess reducing agent. The conditions for the electrochemical dihydrogenation of the corresponding alkoxylated naphthalene derivatives indicated by Diamond and Soffer are above all the following:

use of dioxan/$H_2O$ as catholyte as well as as anolyte — solvent; use of tetra-n-butylammonium iodide as supporting electrolyte operation in a partitioned cell;

use of a Hg cathode, and maintaining constant the cathode potential at −2.5 volts vs S.C.E. (= potentiostatic operation mode).

The reduction batch is worked up by diluting the catholyte with $H_2O$, extraction with petroleum ether and/or $CHCl_3$ and removing the solvent.

Thus, from 2-ethoxynaphthalene there is said to be obtained the corresponding enol ether with a yield of 89%, which enol ether for its part is converted to β-tetralone by hydrolysis and rearrangement.

2,7-dimethoxynaphthalene is said to yield the corresponding enol ether with a 80% yield, from which ether the 7-methoxy-β-tetralone is obtained by hydrolysis and rearrangement.

Finally, 2,7,8-trimethoxy-1,4-dihydronaphthalene is said to be obtained from 2,7,8-trimethoxynaphthalene with a 95% yield of crude product.

When these examples were repeated, it was observed that not pure $\Delta^2$-enol ethers (= 1,4-dihydro compounds), but mixtures of, substantially, $\Delta^2$-enol ethers with some $\Delta^1$- and $\Delta^3$-enol ethers are obtained; furthermore, depending on the kind, the number and the position of the substituents at the naphthalene ring system, hydrogenation occurred at the second ring of the naphthalene too. The reaction products were analyzed above all by $^1$H-NMR and gas chromatography methods.

Although the method described by Diamond and Soffer does not yield pure and unitary enol ethers, it is nevertheless a process for obtaining β-tetralones starting from correspondingly alkoxylated naphthalene. However, the reaction conditions do not allow the process to be carried out on an industrial scale because, on the one hand, the potentiostatic operation mode is disadvantageous in this case, and on the other hand, in view of the rate of flow required for a good current efficiency, the use of a Hg cathode is unprofitable, if not prohibitive. Replacement of the Hg cathode by various fixed electrodes did not bring about satisfactory results either. A further serious disadvantage which makes the adaption of the reaction according to the conditions set by Diamond and Soffer to industrial practice, difficult, if not impossible, resides in an extraordinarily heavy transfer of solvent from the anode zone to the cathode zone.

It is also known to hydrogenate benzene and substituted derivatives thereof subjecting the aromatic compound to an electrolytic process in the presence of a supporting electrolyte especially a propyl and butyl quaternary ammonium salt. (U.S. Pat. No. 3,485,726). The electrolytic solution in which the process is carried out, consists of at least one member selected from the group consisting of water and lower aliphatic alcohols and at least one solvent selected from the group consisting of aliphatic nitriles, aliphatic ethers, and cycloaliphatic ethers. The reference discloses that the electrolytic solution contains a proton donor such as water or a lower aliphatic alcohol or a mixture thereof. In such cases the amount of water ranges from 2 to 40% based on the total volume solution. When water and alcohol are concurrently used, the amount used usually ranges from 3 to 50% by volume. The reference further discloses use of mercury, cadmium, lead and tin as cathode material. Platinum or carbon material may be employed as the anode. Each of the examples discloses treatment of benzene or derivatives thereof and a mixture of water and dimethoxyethane or $CH_3CN$. The reference does not show or suggest that this electrochemical dihydrogenation process can be applied to naphthyl ethers, nor that the starting material be naphthyl ether having the ether group in the 2-position.

Because of the great importance of the β-tetralones, it is the object of the present invention to improve the known processes for the electrochemical reduction of alkoxylated naphthyl ethers in such a manner that it can be carried out profitably and rationally on an industrial scale, too. A further object of the invention is to adapt the process in a manner such that it can be used not only for the 2-alkoxynaphthalenes, but also for naphthalene compounds alkoxylated in 1-position.

In accordance with this invention, there is provided a process for the electrochemical dihydrogenation of naphthyl ethers which comprises subjecting to electrolysis naphthyl ethers having at least one ether group — preferably one ether group especially in 2-position — in a solvent consisting essentially of an alkanol having from 1 to 3 carbon atoms, preferably of methanol, optionally in admixture with a small amount of a cosolvent and containing no more than about 5% by volume of water to electrolysis of galvanostatic operation mode in the presence of a tetramethylammonium or tetraethylammonium salt or hydroxide and/or a tetramethylphosphonium or tetraethylphosphonium salt or hydroxide, preferably tetramethylammonium chloride, methylate or hydroxide, as a supporting electrolyte, in a continuous flow cell with separation of the cathode and anode zones, with the use of a solid cathode having a more cathodic hydrogen overvoltage than that of Cu and a usual solid anode, at a temperature of from −20° to +120° C, preferably from 20° to 70° C, and at a pH of more than about 8, measured by means of a glass electrode after dilution with the double volume of water.

The naphthyl ethers which can be reacted in this manner have the following formula

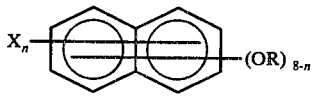

wherein $n$ represents an integer of from 4 to 7, preferably from 5 to 7, especially 7;

R is an alkyl radical, preferably having from 1 to 4 carbon atoms; or a hydroxyalkyl radical with the hydroxy group not in the $\alpha$-position; preferably with 2 to about 20 C-atoms, especially with 2 to 4 C-atoms, whereby the C-atom chains may also be interrupted by heteroatoms (such as oxygen-atoms); or the group

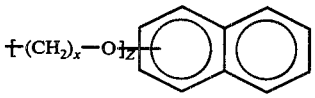

wherein $x$ is an integer from 1 to 10, preferably 2 to 4, especially 2, and $z$ is an integer from 0 to 4, preferably 2 or 3; or $C_6H_5$ and/or $CH_2C_6H_5$; and X is H or a substituent electrochemically inactive at the reduction potential of the starting naphthalene, for example an alkyl radical preferably having from 1 to 4 carbon atoms, $C_6H_5$, F or $NH_2$ radicals which may also be substituents of R.

The radicals R may be different in the case where there are more OR groups per naphthalene nucleus; the same goes for X. Examples of suitable naphthyl ethers are

| | |
|---|---|
| 1-methoxy-<br>2-methoxy-<br>1,6-dimethoxy-<br>1,7-dimethoxy-<br>2,6-dimethoxy-<br>2,7-dimethoxy-<br>2-ethoxy-<br>1-n-butoxy-<br>2-methoxy-6-phenyl-<br>1-methoxy-3-benzyl- | -naphthalene |
| etc. | |

furthermore

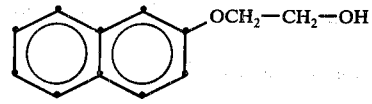

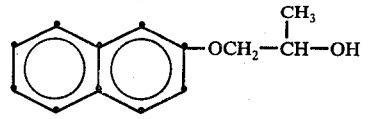

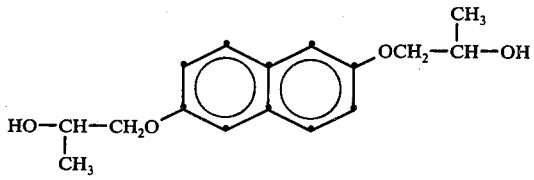

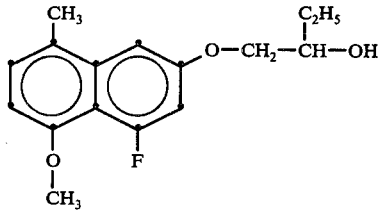

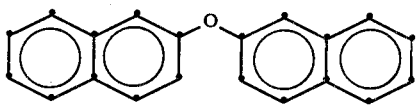

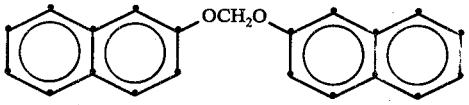

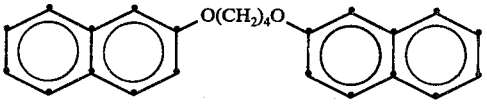

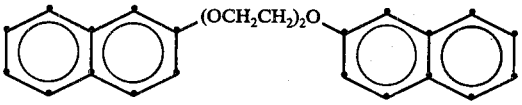

The preferred starting materials for the process of the invention are those naphthyl ethers having only one ether group in the 2-position.

Especially preferred are 2-[$\beta$-hydroxy($C_2$–$C_4$)alkyl] naphthyl ethers, among which the 2-($\beta$-hydroxyethyl)- and the 2-($\beta$-hydroxypropyl)naphthyl ethers are most preferred.

It is advantageous to use as starting material naphthyl ethers those 2-[$\beta$-hydroxy($C_2$–$C_4$)alkyl] naphthyl ethers, which were obtained by oxalkylation of the corresponding $\beta$-naphthols with a ($C_2$–$C_4$)epoxide — preferably with ethylene oxide or propylene oxide — in the solvent supporting electrolyte-mixture of a pH of more than about 8, which is used for the (subsequent) electrolysis.

In the oxalkylation — preferably the oxethylation and the oxpropylation — pH-values of more than about 10, especially more than about 12, are especially advantageous in order to obtain a selective reaction with an especially economic space-time-yield. The oxalkylation is, besides this, conducted at the conditions which are generally applied for oxalkylations, i.e., for example, under pressure at temperatures between about 60° and 150° C, preferably between about 90° and 110° C. The pressure resulting during the exothermic oxalkylation in a closed vessel is about 1 to 10 bar, especially about 3 to 5 bar, when stoichiometric or only slightly excessive (ca. 10 mol%) amounts of epoxide are used.

The 2-[β-hydroxy-($C_2$–$C_4$)alkyl] naphthyl ethers obtained by oxalkylation of the respective β-naphthols in the respective solvent/supporting electrolyte-mixture of a pH of more than 8 may be separated from said mixture before the electrolysis; it is, however, preferred to use the solutions obtained by oxalkylation without separation of the respective 2-[β-hydroxy ($C_2$–$C_4$)alkyl] ethers for the subsequent electrolysis directly.

As solvent for the process of the invention, there is used an alkanol having from 1 to 3 carbon atoms (that is, methanol, ethanol, n-propanol, isopropanol); methanol being preferred. For the reduction of scarcely soluble naphthyl ethers, the alkanol may contain small amounts of a cosolvent such as tetrahydrofuran; however, no more than a maximum of about 30% by volume. No cosolvent is necessary when using hydroxyalkyl-naphthyl ethers as starting materials for the process of the invention, since the hydroxyalkyl-naphthyl ethers are sufficiently soluble in the respective alkanol system.

The solvent should not contain more than about 5% by volume of water; it may be used as catholyte as well as anolyte. It is advantageous when the solvent used is anhydrous or nearly anhydrous. Under these conditions the current efficiency is higher and side reactions (hydrolysis of enol ethers to the corresponding β-tetralones and hydrogenation thereof to β-tetraloles) are substantially suppressed. A water content below about 1% of the total volume in the anolyte and/or catholyte may be adjusted by addition of dehydrating agents such as molecular sieves, orthoformic acid esters etc. The water content may be determined according to the known Karl Fischer method or by gas chromatography.

A satisfactory conductivity of catholyte and anolyte is achieved by addition of a tetramethyl- or tetraethylammonium salt or hydroxide and/or tetramethyl- or tetraethylphosphonium salt or hydroxide. Halides, methosulfates, trifluoromethane sulfates, tosylates, formates, alcoholates etc. may be used as salts; chlorides, methylates or hydroxides being preferred, especially those of tetramethylammonium compounds.

In the anolyte, there may be used a acid such as hydrochloric or sulfuric acid, etc., as conductivity promotor, if only a pH above approximately 8 is maintained in the catholyte. This pH is adjusted advantageously by adding a tetramethyl- or tetraethylammonium and/or tetramethyl- or tetraethylphosphoniumhydroxide or methylate to the catholyte. The pH of the catholyte may alternatively be adjusted by concentration of the onium compound in the anolyte since, when a cation exchange membrane is used, the ammonium or phosphonium ion migrates during the electrolysis to the catholyte, where hydroxyl or alcoholate ions are formed. When an anion exchange membrane is used, the migration of the anions from the catholyte ensures that the intended pH of above approximately 8 is adjusted. There is practically no limit in the alkaline range; however, only a pH of up to about 15 to 16 makes sense for technological applications. The pH is measured by means of a glass electrode after dilution of a sample with the double amount by volume of water; a less precise measurement may be obtained by using wet Litmus paper.

There may be used one of the cited supporting electrolytes per se or a mixture of several of these compounds. The amount to be used depends on their solubility and the intended work-up of the catholyte. In case of a work-up by distillation it is recommended to use an amount of supporting electrolyte as low as possible (up to about 0.2 mol/liter of total electrolyte amount) in case of work-up by extraction, for example by means of extraction or pulsation columns, higher concentrations of conducting salt of up to more than about 1 mol per liter of total electrolyte amount are advantageous.

The electrolysis process according to this invention is carried out in known continuous flow cells with partition into a cathode and an anode zone by means of a diaphragm, for which all usual materials such as porous plates, glass filters etc. or ion exchange membranes may be used. For adjusting the intended pH in the catholyte, the use of cation exchange membranes, especially those which are perfluorinated in order to attain a high thermal and mechanical stability, is advantageous.

Suitable cathode materials are solids the negative hydrogen overvoltage of which is inferior to that of Cu, for example amalgamated copper, Cd, Pb or graphite. Preferred are cadmium or cadmium-plated iron, cadmium-plated copper etc.

The anode may consist of the usual solids known as anode material which, of course, have to be substantially resistant to anodic dissolution. Graphite is the preferred material.

The design of the electrodes, that is, of the cathode as well as of the anode, is not critical. The process can be carried out with the use of simple plates, nets, expanded metals (also combinations thereof) and structured electrodes.

Depending on the depolarizer used, the flow rate of the catholyte at the cathode may vary within a wide range (10 cm/sec to 2.5 m/sec or more). For example, the reaction of 2-methoxynaphthalene gives similar yields not only at a flow rate of more than about 1 m/sec (as indicated in Examples 1 to 5), but also at flow rates of about 20 cm/sec. Preferred are flow rates above 0.5 l m/sec, especially above 0.8 m/sec; the upper limit of flow rate not being critical and substantially a constant of the apparatus. The flow rate of the anolyte is not critical either and generally in the same range. However, there should be the same pressure conditions on both sides of the membrane.

The cathode current density (relative to the formal surface) may be in a range of from about 2 to 200 A/dm$^2$, depending on the kind of electrodes and the electrolysis conditions chosen; preferred is a current density of from about 5 to 100 A/dm$^2$.

The current consumption should be advantageously from 2 to 2.6 faradays per mol of starting compound; however, larger quantities are not disadvantageous. On the other hand, in certain cases a premature stopping of the reaction (current consumption below 2 faradays per mol of starting compound) may be recommended because of simultaneous development of hydrogen towards the end of the reduction.

The electrolysis temperature may be varied within wide limits and is generally from about −20 to +120° C, preferably 20° to 70° C. In the case where scarcely soluble starting compounds such as 2-methoxynaphthalene are used, temperatures of about 40° to 50° C in the catholyte result in concentrations of depolarizer (= compound to be reduced) which allow the obtention of industrially interesting current densities and area-time yields.

According to the process of the invention, dihydrogenated naphthalene derivatives are obtained. Depending on whether a naphthalene having an ether substituent in the 1- or in 2-position is used as starting material, dihydrogenation occurs in that ring on which the ether substituent is not situated (in the case of naphthalene-1-ethers) or where it is situated (in the case of naphthalene-2-ethers). When a naphthalene-1-ether is used as starting compound, there is obtained substantially the corresponding 5,8-dihydronaphthalene, and, to a smaller extent, the tetrahydro compound, too. When a naphthalene-2-ether is used as starting material, there is obtained mainly the 1,4-dihydro compound and, to a smaller extent, other dihydro compounds such as the 1,2- and 3,4-dihydro products.

In the case where the starting naphthalene is substituted by several ether groups, it is possible that an uncontrollable hydrogenation occurs. Therefore, it is advantagous to start from a naphthalene derivative having only one ether group or a naphthalene derivative having several ether groups which are positioned in such a manner that they cause the dihydrogenation to proceed in one determined direction only, as in the case of the 1,6-diether-naphthalenes, (where dihydrogenation occurs substantially in 5,8-position), or in the cases of 2,6- and 2,7-diethernaphthalenes (where dihydrogenation occurs substantially in 1,4-position).

The reaction batch may be worked up according to known methods. However, it depends on the kind of work-up whether there is isomerization or not of the corresponding dihydro products. When the work-up is carried out in a manner as carefully and gently as possible, there is practically no isomerization. Such a work-up under mild conditions is for example extraction of the catholyte with a suitable solvent such as petroleum ether or methylene chloride, for example after previous addition of water. A 1,4-dihydro compound which is formed first is generally maintained as such.

In the case of less mild work-up conditions, there is isomerization in such a manner that a double bond at the dihydrogenated ring not being in conjugation position to the aromatic system of the nonhydrogenated ring migrates to such a conjugation position to this ring. Distillation work-up is an example for such a less gentle method. In the case where isomerization of the 1,4-dihydrogenated products to form the conjugated 3,4- or 1,2-dihydrogenated compounds is intended, higher concentration rates of basic supporting electrolytes, especially of tetramethylammonium or -phosphonium hydroxides or methylates, are advantageous The success of the process of this invention was extremely surprising. Replacement of Hg according to the operation mode of Diamond and Soffer by solid electrodes according to this invention gives an unsatisfactory result (Cu/Hg, Cd) or no result whatsoever (Pb, graphite) probably, as already mentioned before, because of the too low hydrogen overvoltage attained with these solid electrodes in this electrolyte system. It was therefore not at all to be expected that the reaction would succeed despite the cited handicaps with the use of precisely the above solid electrodes. One would have rather thought of replacing the tetrabutylammonium iodide of the Diamond and Soffer process by such tetraalkylammonium salts which contain higher alkyls as substituents at the nitrogen, since such supporting electrolytes have a higher limit potential; in the presence of such supporting electrolytes containing higher alkyl radicals at the nitrogen the hydrogen overvoltage rises again at the electrodes used, so that the lower hydrogen overvoltage at several solid electrodes may be compensated by such supporting electrolytes as is known.

However, it was just the opposite of the above which was realized according to the process of the invention. No tetramethylammonium salts having higher alkyl radicals at the nitrogen are used as supporting electrolytes, but tetramethyl- and tetraethylammonium and -phosphonium salts or hydroxides, that is, tetraalkylammonium and -phosphonium compounds containing the shortest possible alkyl radicals. Probably, the required high hydrogen overvoltage is obtained by replacing the dioxan/ water system of Diamond and Soffer by practically anhydrous alkanol, preferably methanol, optionally in admixture with small amounts of a cosolvent, according to this invention. In the process of the invention, there are thus combined several items known from similar reactions in a non-obvious manner which proved to be surprisingly successful just because of its special kind.

The process of the invention allows to carry out the reaction according to Diamond and Soffer in an economic and profitable manner on an industrial scale, which is due above all to the use of corresponding fixed electrodes. A further advantage resides in the fact that inexpensive tetramethyl- or tetraethylammonium (and -phosphonium) compounds may be used as supporting electrolytes, also in small amounts. While the process of Diamond and Soffer operates with a high supporting electrol./depolarizer ratio of about 4.7 : 1 (mol : mol) or 8.8 : 1 (kg: kg), a ratio of about 0.3 : 1 (mol:mol) or 0.2 : 1 (kg:kg) and less may be chosen according to the process of the invention. Especially remarkable is the fact that the process, in contrast to that of Diamond and Soffer may be carried out according to the galvanostatic operation mode, that is, without maintaining constant the cathode potential. While a relatively low current density is required for the Diamond and Soffer process, the process of this invention is carried out at a considerably higher current density. When the examples of Diamond and Soffer were repeated, a maximum current density of about 10 $mA/cm^2$ was stated, while that of the process of the invention was at least about 200 $mA/cm^2$. Because of this higher current density, considerably higher space-time yields can be obtained according to the process of the invention. While the space-time yield of the Diamond and Soffer process is said to be 3 g/l.h (according to the indicated data) — in the repetition, however, a space-time yield of only 1 g/l.h was found — that of the process of the invention was at least 20 g/l.h. In addition to the advantage of considerably less transfer of solvent from the anolyte to the catholyte, a lower specific energy consumption may be cited in favor of the process of the invention. While the repetition of the Diamond and Soffer process required more than about 20 kWh/kg, the process of the invention consumes less than about 5 kWh/kg of specific energy.

The process of the invention is especially advantageous when starting with hydroxyalkyl naphthyl ethers-especially with 2-[$\beta$-hydroxy($C_2$-$C_4$) alkyl] naphthyl ethers — since these hydroxyalkyl-naphthyl ethers can be prepared more easily than the alkylnaphthyl ethers, which must usually — before the electrolysis — be purified, for example, by distillation and/or recrystallisation. Contrary thereto, the preferred 2-[β-hydroxy($C_2$–$C_4$) alkyl] naphthylethers can be prepared by simple oxalkylation of the corresponding β-naphthols in a solvent/supporting-electrolyte-system as used for the subsequent electrolysis, in which solvent/supporting electrolyte-system the oxalkylated naphthyl ethers may, then, be subjected to the electrolysis-process of the invention directly.

The corresponding β-tetralones may be obtained according to the process of the invention when starting from corresponding 2-(hydroxy-) alkoxynaphthalenes, obtaining the 1,4,-, 3,4- or 1,2-dihydro products and hydrolyzing them. Of course, the reaction may be applied also to other (hydroxy-)alkoxynaphthalenes which do not yield β-tetralones in the end.

The following examples illustrate the invention. Two comparative examples precede the genuine examples according to this invention.

COMPARATIVE EXAMPLE 1

Attempt to reproduce the specification of G. B. Diamond and M. D. Soffer, J. Am. Chem. Soc. 74, 4126 (1952)

Electrolysis:

Anode: platinum net, geometric surface 20 $cm^2$

Cathode: Hg pool, 50 $cm^2$

Diaphragm: cellophane (cellulose sheet regenerated with glycerol of Hoechst Ag, Kalle subsidiary)

Electrolyte: 600 ml dioxan, 200 ml $H_2O$, 44 g (0.12 mol) tetran-butylammonium iodide (→810 ml), 540 ml of which as catholyte, 270 ml as anolyte Temperature: 50° C, agitation: weak nitrogen current Cathode potential: -2.5 volts vs S.C.E.

Basic current: 0.04 A (after pre-electrolysis of 350 Asec without depolarizer)

Depolarizer: 5.01 g (0.029 mol) 2-ethoxynaphthalene

Current density: about 10 mA/$cm^2$ (at -2.5 volts vs S.C.E.) at the start of the electrolysis, after 6174 Asec (corresponding to 2.2 faradays/mol or 110% of current consumption) 1.5 mA/$cm^2$ Cell voltage: start: 60 volts, end: about 20 volts.

Work-up:

According to the indication of Diamond and Soffer: removal of catholyte, addition of the same volume of $H_2O$, extraction with petroleum ether and removal thereof.

Catholyte volume: 605 ml (increase of about 33 ml/ampere hour)

Material yield (crude): 98% of theory, relative to quantitative dihydrogenation (literature: 96% of theory)

Material yield (after distillation): 89% of theory, relative to quantitative dihydrogenation (literature 89.5% of theory).

Composition of Product (according to gas chromatography and $^1$H-NMR spectroscopy):

77.8% 1,4-dihydro-2-ethoxynaphthalene 9.8% 5,6-, 7,8- and/or 5,8-dihydro-2-ethoxynaphthalene 10% unreacted starting material.

The material yield of 1,4-dihydro compound which can be converted to β-tetralone is 69.2% of theory (literature: 79.6% of theory).

Current efficiency: about 71% with all dihydro compounds Specific energy consumption: 20 kWh/kg of isomer mixture Space-time yield: about 1 g/l.h

COMPARATIVE EXAMPLE 2

Attempt of adapting the dihydrogentation according to the conditions indicated by Diamond and Soffer to a solid cathode, for example Cd, and galvanostatic operation mode Electrolysis:

As in Comparative Example 1, but galvanostatic operation mode

Cathode: Cd sheet (99.999%) 45 $cm^2$

Current density: 25 mA/$cm^2$

Agitation: the catholyte is pump-circulated at a rate of 500 l/h (rotary pump).

Work-up:

According to the indications of Diamond and Soffer. Material yield (after distillation): 90% of theory of unreacted 2-ethoxynaphthalene. Under the agitation conditions of Comparative Example 1, the same negative result is obtained.

EXAMPLE 1

In all cases the electrolysis cell is a partitioned continuous flow cell made from polyethylene and having a minimalized electrode distance. The diaphragm is a perfluorinated cation exchanger membrane (Nafion XR 475, DuPont). The geometric cathode and anode areas are 200 $cm^2$, their distance from the diaphragm is a maximum 1 mm, the flow rate of the catholyte is at least 1 m/sec. Devices for thermostating and feeding-in the required chemicals are outside of the cell in the electrolyte circulation systems.

Electrolysis

Anode:
- electrolysis graphite

Anolyte:
- 2050 g (2.7 1) $CH_3OH$ (industrial-grade)
- 520 g (4.74 mols) $(CH_3)_4NCl$ Cathode:
- amalgamated copper sheet Catholyte:
- 2900 g (3.66 1) $CH_3OH$ (industrial-grade)
- 260 g (2.37 mols) $(CH_3)_4NCl$
- 633 g (4 mols) 2-methoxynaphthalene Temperature: 40° – 50° C Cathode current density: 20 A/$dm^2$ Average cell voltage: 8 volts Current consumption: 2.6 faradays/mol pH in the catholyte:
- 8.5 shortly after start of test
- 13.5 at the end of test Concentration of $H_2O$ in catholyte:
- 0.2% by weight (start of test)
- 0.6% by weight (end of test)

in anolyte:
- 0.2% by weight (start of test)
- 2.0% by weight (end of test)

End of catholyte:
- 5600 g (weight increase about 6 g/ampere hour)

Work-up (isomerizing):

In order to remove the supporting-electrolyte, the residue obtained after having distilled off the methanol under normal pressure is washed with water, and the organic phase is distilled off. MY (material yield of distilled material, relative to quantitative dihydrogenation): 94% of theory.

Isomer distribution:

The isomer distribution is determined in all cases by gas chromatography and/or 1H-NMR spectroscopy.

15.6% 5,6-, 7,8- and/or 5,8-

56.2% 3,4- and

25% 1,2-dihydro-2-methoxynaphthalene. The 1,2-dihydro compound may be isomerized to the 3,4-dihydro compound by heating the distillation residue for one to two hours at 80° - 90° C, as in Examples 3 and 4.

3.1% starting material

CE (current efficiency, relative to distilled dihydro compounds): 70% of theory

Specific energy consumption: 3.8 kWh/kg of dihydro compound.

Space-time yield: about 18.5 g/h.1

Area-time yield: about 0.4 g/cm$^2$.h

EXAMPLE 2

Electrolysis:

According to Example 1

Work-up (mild conditions):

The catholyte is diluted with the 3-fold amount by weight of water and extracted several times with methylene chloride, or directly extracted with gasoline without adding water in an extraction or pulsation column (80° - 110° C). The methylene chloride or gasoline extract is worked up by distillation. MY: 95% of theory.

Isomer distribution:

15.7% 5,6-, 7,8- and/or 5,8-

15.8% 3,4-

33.6% 1,4- and 28.4% of 1,2-dihydro-2-methoxynaphthalene, and 6.3% starting material.

CE: 63.3% of theory.

The methanolic solution of supporting electrolyte obtained after extraction with gasoline may be reused as catholyte after having been combined with fresh 2-methoxynaphthalene; the anolyte may be reused too. Alternatively, it is possible to combine the extracted catholyte with the anolyte of the same test and to use this solution as anolyte for the subsequent test; addition of fresh cathodic supporting electrolyte may be omitted.

EXAMPLE 3

Electrolysis

As in Example 1; however, 160 g (1.5 mols) of orthoformic acid trimethyl ester are added to the catholyte and 460 g (4.3 mols) of this ester to the anolyte, that is, excess quantities.

Work-up:

As in Example 1

MY: 97% of theory

Isomer distribution:

19.6% 5,6-, 7,8- and/or 5,8-, 79.4% 3,4-dihydro-2-methoxynaphthalene.

$\lesssim$ 1% starting material

CE: 73.9% of theory.

By the addition of orthoformic acid trimethyl ester, the anolyte and catholyte are maintained anhydrous and free from formic acid. These electrolytes may be reused as indicated in Example 2 and for further tests without deteriorating the selectivity of the dihydrogenation.

EXAMPLE 4

Electrolysis

As in Example 1, but cathode current density 650 mA/cm$^2$ mean cell voltage 11.5 volts Work-up: As in Example 1

MY: 95% of theory

Isomer distribution:

19.9% 5,6-, 7.8- and/or 5,8-

77.9% 3,4-dihydro-2-methoxynaphthalene 2.1% starting material

CE: 71.5% of theory

Specific energy consumption: 5.4 kWh/kg

Space-time yield: about 60 g/l.h

Area-time yield: about 1.3 g/cm$^2$.h

Similar results are obtained when a copper sheet is used as cathode to which sheet 2 layers of copper expanded metal are applied before amalgamation.

EXAMPLE 5

Electrolysis

As in Example 1, however:

anolyte 2050 g (2.7 1) $CH_3OH$ (ind.-grade)

130 g (1.18 mols) $(CH_3)_4NCl$ catholyte 2900 g (3.66 1) $CH_3OH$ (ind.-grade)

633 g (4mols) 2-methoxynaphthalene

Cell voltage after 3% current consumption: 19 volts

Cell voltage towards the end of electrolysis: 10.5 volts

Cell voltage average: 12 volts pH start in catholyte: 6.5 (rises immediately after start of electrolysis to about 8.5 at first)

pH end in catholyte: 12.3

$^{C}H_2O$ start in catholyte: 0.2% by weight, in anolyte: 0.2% by weight $^{C}H_2O$ end in catholyte: 0.3% by weight, in anolyte: 0.4% by weight.

Work-up: (isomerizing and gentle; the results of the gentle work-up are indicated in brackets as follows):

MY: 97 (96) % of theory

Isomer distribution:

16.5 (16.6) % 5,6-, 7,8- and/or 5,8-, 64.9 (24.9) % 3,4-

- (31.2) % 1,4- and 13.4 (22.9) % 1,2-dihydro-2-methoxynaphthalene, and 5.0 (4.1) % starting material CE: 70.7 (70.6) % of theory Specific energy consumption: about 5.7 kWh/kg

EXAMPLE 6

Electrolysis: as in Example 5, but: cathode: cadmium sheet

Work-up: as in Example 5

MY: 98 (97) % of theory.

Isomer distribution:

14.2 (13.4) % 5,6-, 7,8- and/or 6,8-, 73.4 (12.3) % 3,4-

9.1 (20.6) % 1,2-

- (50.5) % 1,4-dihydro-2-methoxynaphthalene, and 3 (3.1) % starting material

CE: 72.9 (72.2) % of theory.

EXAMPLE 7

Electrolysis: as in Example 5, but: cathode: graphite ("Glassy Carbon" of Sigri Elektrographite GmbH)

Work-up: as in Example 1
MY: 100% of theory
Isomer distribution:
8% 5,6-, 7,8- and/or 5,8-
30% 3,4- and
28% 1,2-dihydro-2-methoxynaphthalene, and
22% starting material
CE: 50.8% of theory.

EXAMPLE 8

Electrolysis: as in Example 5, but: cathode: copper/refined lead

Work-up: as in Example 5
MY: 99 (97) % of theory.
Isomer distribution:
11 (10) % 5,6-, 7,8- and/or 5,8-
45 (12) % 3,4-
29 (35) % 1,2-
- (27) % 1.4-dihydro-2-methoxynaphthalene
14 (15) % starting material
CE: 38 (37) % of theory.

EXAMPLE 9

Electrolysis: as in Example 1, but: depolarizer: 689 g (4 mols) 2-ethoxynaphthalene Work-up: as in Example 5
MY: 96 (97) % of theory.
Isomer distribution:
15.6 (3.1) % 5,6-, 7,8- and/or 5,8-
80.2 (19.5) % 3,4-
- (62.8) % 1,4-
4.1 (14.4) % starting material
CE: 70.7 (63.7) % of theory.

Example 10

Electrolysis: as in Example 1, but: depolarizer: 540 g (2 mols) di-β-naphthyl ether, 0.9 l of the catholyte methanol is replaced by tetrahydrofuran.

Work-up:
(a) "isomerizing" (as in Example 1)
MY: 62 % of theory bis-3,4-dihydro-di-β-naphthyl ether
CE: 47 % of theory
(b) "gentle" (as in Example 2)
MY: 59 % of theory bis-1,4-dihydro-di-β-naphthyl ether
CE: 45 % of theory.

EXAMPLE 11

Electrolysis: as in Example 1, but: depolarizer: 96 g (0.32 mol) methylene-di-β-naphthyl ether: 0.9 l of catholyte methanol replaced by tetrahydrofuran.

Work-up:
(a) "isomerizing" (acc. to Example 1)
MY: 95 % bis-3,4-dihydro-methylene-di-β-naphthyl ether
CE: 35 % of theory
(b) "gentle" (acc. to Example 2)
MY: 90 % bis-1,4-dihydro-methylene-di-β-naphthyl ether
CE: 33 % of theory.

EXAMPLE 12

Electrolysis: as in Example 1, but: depolarizer: 108 g (0.33 mol) 1,3-propanediol-di-β-naphthyl ether; 0.9 l of catholyte methanol replaced by tetrahydrofuran.

Work-up:
(a) isomerizing (acc. to Example 1)
MY: 90 % bis-3,4-dihydro-1,3-propanediol-di-β-naphthyl ether (acc. to $^1$H NMR in crude product)
CE: 30 % of theory
(b) gentle
The original catholyte is abandoned for 36 hours at 0° C and the precipitated crystals are then suction-filtered.
MY: 79 % bis-1,4-dihydro-1,3-propanediol-di-β-naphthyl ether
CE: 30 % of theory.

EXAMPLE 13

Electrolysis: as in Example 1, but: depolarizer: 189 g (0.53 mol) diethyleneglycol-di-β-naphthyl ether; 0.9 l of catholyte methanol replaced by tetrahydrofuran.

Work-up:
(a) isomerizing (acc. to Example 1)
MY: 90 % bis-3,4-dihydro-diethyleneglycol-di-β-naphthyl ether (acc. to $^1$H-NMR in crude product)
CE: 36 % of theory
(b) gentle (acc. to Example 2)
MY: 90 % bis-1,4-dihydro-diethyleneglycol-di-β-naphthyl ether (acc. to $^1$H NMR in crude product)
CE: 35 % of theory.

EXAMPLE 14

Electrolysis: as in Example 1, but: depolarizer: 116 g (0.29 mol) triethyleneglycol-di-β-naphthyl ether; 0.45 l of catholyte methanol replaced by tetrahydrofuran Work-up:
(a) isomerizing (acc. to Example 1)
MY: 90 % bis-3,4-dihydro-triethyleneglycol-di-β-naphthyl ether (acc. to $^1$H-NMR in crude product)
CE: 23 % of theory
(b) gentle (acc. to Example 2)
MY: 85 % bis-1,4-dihydro-triethyleneglycol-di-β-naphthyl ether (acc. to $^1$HNMR in crude product)
CE: 21 % of theory.

EXAMPLE 15

Electrolysis: as in Example 1, but: depolarizer: 238 g (1.26 mol) 2,6-dimethoxynaphthalene; 0.9 l catholyte methanol replaced by tetrahydrofuran.

Work-up: (acc. to Example 5)
MY: 92 (96) % of theory (after distillation)
Isomer distribution:
94 (33.3) % 3,4-
- (62.5) % 1,4-dihydro-2,6-dimethoxynaphthalene, and
5 (4) % starting material
CE: 67 (71) % of theory.

EXAMPLE 16:

Electrolysis: as in Example 1, but: depolariser: 376 g(1,99 mols) 2,7-dimethoxynaphthalene Work-up: (acc. to Example 5)
MY: 96 (94) % of theory (after distillation)
Isomer distribution:
73.9 (37.2) % 3,4-, 25 (21.2) % 1,2-,
- (41.5) % 1,4-dihydro-2,7-dimethoxynaphthalene
1 (-) % starting material
CE: 73 (72) % of theory.

EXAMPLE 17

Electrolysis: as in Example 1, but: depolarizer: 633 g (4 mols) 1-methoxynaphthalene Work-up: acc. to Example 5
MY: 90 (87) % of theory (after distillation)
Isomer distribution:
9.1 (9.4) % 5,6,7,8-tetrahydro-1-methoxynaphthalene,
34.9 (-) % 5,6- or 7,8-
31.3(-) % 7,8- or 5,6-
- (63.3)% 5,8-dihydro-1-methoxynaphthalene
24.4 (24.6) % starting material
CE: 54 (50) % of theory.

EXAMPLE 18

Electrolysis: as in Example 1, but: depolarizer: 310 g (1,65 mols) 1,6-dimethoxynaphthalene Work-up: (acc. to Example 5)
MY: 87 (86) % of theory (after distillation)
Isomer distribution:
90.8 (20.9) % 7,8-,
4.5 (67.4) % 5,8-dihydro-1,6-dimethoxynaphthalene
4.5 (9.3) % starting material
CE: 64 (58) % of theory.

EXAMPLE 19

Electrolysis: as in Example 1, but: depolarizer: 306 g (1.63 mols) 1,7-dimethoxynaphthalene Work-up: (acc. to Example 5)
MY: 95 (95) % of theory
Isomer distribution:
89.4 (37.9) % 5,6-,
8.4 (54.7) % 5,8-dihydro-1,7-dimethoxynaphthalene,
2.1 (7.3) % starting material
CE: 72 (66) % of theory.

EXAMPLE 20

Electrolysis: as in Example 1, but:

anode: electrolysis graphite
anolyte: 2930 g (ca. 3.7 l) $CH_3OH$ (industrial grade), in the course of the experiment supplemented by 1450 g (ca. 1850 ml) $CH_3OH$ (industrial grade) 130 g $(CH_3)_4NCl$
cathode: amalgamated copper sheet
catholyte: 1150 (ca. 1.45 l) $CH_3OH$ (industrial grade) 752 g (4 mols) 2-$\beta$hydroxyethyl-naphthyl ether (purity ca. 99%)
temperature: 40°-50° C
cathode current density: 25 A/dm$^2$
average cell voltage: ca. 10 volts
current composition: 2.6 faradays/mol (278 Ah)
pH in the catholyte:
ca. 8.5 shortly after start of the experiment
ca. 13.5 at the end of the experiment
concentration of $H_2O$ in the catholyte:
ca. 0.2% by weight (start of the experiment)
ca. 0.5% by weight (end of the experiment)
pH in the anolyte:
ca. 6.5 at the start of the experiment
ca. 1 at the end of the experiment
concentration of $H_2O$ in the anolyte:
ca. 0.2% by weight (start of the experiment)
ca. 0.6% by weight (end of the experiment)
weight of the catholyte after the experiment: ca. 3400 g
weight of the anolyte after the experiment: ca. 3000 g Since the dihydro -compounds formed are difficult to identify and to separate, the electrolysis batch is worked up to yield $\beta$-tetralone as follows:

anolyte and catholyte are united and the solvent is distilled off. To the distillation residue 2 l of $H_2O$ are added, and the pH is adjusted to 1 by the addition of ca. 70 g conc. hydrochloric acid. The mixture is stirred for 3 hours at ca. 100° C. After cooling, the organic phase is separated and fractionated over a 1 m distillation column in vacuo. At 76°-86° C/0.2 mm Hg 449 g of a distillate are obtained, which is identified by gas-chromatographie analysis (2.5 m methyl silicone, 190° C isothermic, 27.5 ml He/min) as being 62 -tetralone of about 98.7% purity. This corresponds to a (material) yield of 76% of theory and a current efficiency of 57% of theory, based on the initial 62-hydroxyethyl naphthyl ether.

Specific energy consumption: ca. 6.5 kWh/kg of $\beta$-tetralone.

EXAMPLE 21

(a) pre-electrolysis:
anode: electrolysis graphite
anolyte: 2930 (ca. 3.7 l) $CH_3OH$ (industrial grade), in the course of the experiment supplemented by
450 g (ca. 570 ml) $CH_3OH$ (ind. grade)
130 g $(CH_3)_4NCl$
cathode: amalgamated copper sheet
catholyte: 1130 g (ca. 1.43 l) $CH_3OH$ (industrial grade)
temperature: 40°-50° C
cathode current density: 20 A/dm$^2$
average cell voltage: ca. 8 volts
current consumption: 87 Ah After this pre-electrolysis the catholyte contains ca. 1.07 mol of $(CH_3)_4NOCH_3$ and/or $(CH_3)_4NOH$, corresponding to a current efficiency of 66% of theory.

To this solution
576 g of $\beta$-naphthol (4 mols) and
194 g (4.4 mols) of ethylene oxide are added, and the mixture is heated in a closed 4 l enamel vessel in the course of 15 minutes to 95°-100° C with stirring. Thereby the pressure rises to 3.2 bar, but falls again within 1 hour to 2.3 bar, and remains constant during the subsequent 1 hour after-heating. The vessel is cooled to room temperature, and the resulting brown solution, the high-boiling ingredients of which are
<2% by weight of $\beta$-naphthol
>96% by weight of 2-$\beta$-hydroxyethyl naphthyl ether
<2% by weight of diethylene glycol-mono-$\beta$-naphthyl ether, is subjected to electrolysis (b) electrolysis:
the anolyte of the pre-electrolysis is in the course of the experiment again supplemented by
1450 g (ca. 1850 ml) $CH_3OH$ (ind. grade)
temperature: 40°-50° C
cathode current density: 25 A/dm$^2$
average cell voltage: ca. 10 volts
current consumption: 2.6 faradays/Mol (278 Ah)
pH in the catholyte:
ca. 13.5 at the start of the experiment
ca. 13.0 at the end of the experiment concentration of $H_2O$ in the catholyte:
ca. 0.3% by weight (start of experiment)
ca. 0.6% by weight (end of experiment)
pH of the anolyte:
ca. 1 at the start of the experiment
ca. 1 at the end of the experiment
concentration of $H_2O$ in the anolyte:
ca. 0.4% by weight (start of experiment)
ca. 0.7% by weight (end of experiment)
resulting weight of the catholyte: ca. 3 800 g
resulting weight of the anolyte: ca. 3 000 g The yield of the dihydrogenated product is — as in Example 19 - determined by conversion into β-tetralone:

475 g of β-tetralone (purity 98.1%), corresponding to 79.5% of theory, based on the initial β-naphthol.

Current efficiency (including the pre-electrolysis): 45% of theory specific energy consumption: ca. 8 kWh/kg β-tetralone

I claim:

1. A process for the electrochemical dihydrogenation of naphthyl ethers which comprises subjecting naphthyl ethers having at least one ether group in a solvent consisting essentially of an alkanol having from 1 to 3 carbon atoms, optionally in admixture with a small amount of a cosolvent, and containing no more than about 5 % by volume of water and at least one supporting electrolyte selected from the group consisting of
tetramethylammonium salt
tetraethylammonium salt
tetramethylammonium hydroxide
tetraethylammonium hydroxide
tetramethylphosphonium salt
tetraethylphosphonium salt
tetramethylphosphonium hydroxide and
tetraethylphosphonium hydroxide as a catholyte to electrolysis in a continuous flow diaphragm cell using a solid cathode having a more cathodic hydrogen overvoltage than that of Cu, and the usual solids an anode material, at temperatures of from −20° to +120° C, and at a pH of at least about 8.

2. The process as claimed in claim 1, in which the starting naphthyl ethers are those having an ether group in the 2-position.

3. The process as claimed in claim 1, in which naphthyl ethers are 2-[β-hydroxy-($C_2$–$C_4$)-alkyl]naphthyl ethers.

4. The process as claimed in claim 3, in which the naphthyl ether is 2-(β-hydroxyethyl)naphthyl ether.

5. The process as claimed in claim 3, in which the naphthyl ether is 2-(β-hydroxypropyl)naphthyl ether.

6. The process as claimed in claim 1, in which the alkanol is methanol.

7. The process as claimed in claim 1, in which the supporting electrolyte is at least one member selected from the group consisting of tetramethylammonium chloride, tetramethylammonium methylate and tetramethylammonium hydroxide.

8. The process as claimed in claim 1, in which the cathode material is cadmium or a cadmium-plated metal.

9. The process as claimed in claim 1, in which the anode material is graphite.

* * * * *

UNITED STATES PATENT AND TRADEMARK OFFICE

CERTIFICATE OF CORRECTION

PATENT NO. : 4,115,216
DATED : September 19, 1978
INVENTOR(S) : Skaletz

It is certified that error appears in the above-identified patent and that said Letters Patent are hereby corrected as shown below:

In the Heading, Item [30], after "Foreign Application Priority Data," insert

--April 27, 1976 Fed. Rep. of Germany 26 18 276--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*